US008168907B2

(12) United States Patent
Nemetz

(10) Patent No.: US 8,168,907 B2
(45) Date of Patent: May 1, 2012

(54) SWITCH MECHANISM FOR A POWER CUTTER

(75) Inventor: Uwe Nemetz, Huenfelden (DE)

(73) Assignee: Black & Decker Inc., Newark, DE (US)

( * ) Notice: Subject to any disclaimer, the term of this patent is extended or adjusted under 35 U.S.C. 154(b) by 412 days.

(21) Appl. No.: 12/496,925

(22) Filed: Jul. 2, 2009

(65) Prior Publication Data

US 2010/0000846 A1 Jan. 7, 2010

(30) Foreign Application Priority Data

Jul. 4, 2008 (GB) ..... 0812274.9

(51) Int. Cl.
*H01H 5/00* (2006.01)

(52) U.S. Cl. ..... 200/400

(58) Field of Classification Search ..... 200/400, 200/50.32, 50.36, 50.33, 5 B–5 D, 50.01, 200/50.37, 316–322, 332.2, 61.85, 4, 5 R
See application file for complete search history.

(56) References Cited

U.S. PATENT DOCUMENTS 2,948,792 A 8/1960 Elliott et al.
3,170,995 A 2/1965 Mullen
3,919,506 A * 11/1975 Kellogg ..... 200/16 A
4,362,196 A 12/1982 Ferdinand et al.
5,005,295 A 4/1991 Fushiya
5,136,130 A 8/1992 Daly
5,369,230 A * 11/1994 Misawa ..... 200/52 R
6,057,518 A 5/2000 Bascom et al.
6,958,455 B1 10/2005 Lui
7,112,751 B2 9/2006 Turley
7,439,458 B2 * 10/2008 Montalvo ..... 200/4
7,920,075 B2 * 4/2011 Wu ..... 341/35

OTHER PUBLICATIONS

Search Report of Oct. 13, 2008 re corresponding UK patent application, No. 0812274.9 to which priority is claimed.
Findeli—European Search Report re corresponding European patent application, publication No. EP 09163594—Sep. 6, 2011—Munich.

* cited by examiner

*Primary Examiner* — Edwin A. Leon
(74) *Attorney, Agent, or Firm* — Rhonda L. Barton; Adan Ayala

(57) ABSTRACT

A switch mechanism for a power tool switchable between an ON and OFF state including a support structure; a first actuator rotatably mounted on the support structure and which is rotatable between a first position and a second position, wherein the first actuator is capable of being releasably latched in either of the first or second positions. The first actuator includes a recess. A second actuator is a slidable button located inside of the recess of the first actuator so that the first actuator at least partially surrounds the second actuator, and is linearly slidable within the recess between a first position and a second position. The second actuator is biased towards its first position. Movement of the first actuator from its first position to its second position, when the second actuator is in its first position, switches the switching mechanism to its ON state; and movement of the first actuator from its second position to its first position, when the second actuator is in its first position, switches the switching mechanism to its OFF state. Movement of the second actuator from its first position to its second position, when the first actuator is latched in its second position, switches the switch mechanism to its OFF state.

14 Claims, 9 Drawing Sheets

SWITCH MECHANISM FOR A POWER CUTTER

CROSS REFERENCE TO RELATED APPLICATIONS

This application claims foreign priority under 35 U.S.C. §119(a) to Applicant's United Kingdom Patent Application No. 08 122 74.9 filed on Jul. 4, 2008. The entirety of this application is incorporated herein by reference.

BACKGROUND OF THE INVENTION

Field of the Invention

The present invention relates to a switch mechanism, in particularly to a switch mechanism for a power tool such as a power cutter.

A typical power cutter includes a housing in which is mounted a two stroke internal combustion engine. Attached to the side of the housing is a support arm which extends forward of the housing. Rotatably mounted on the end of the support arm is a cutting blade, usually in the form of a grinding disk. The motor is drivingly connected to the cutting blade via a drive belt. The rotary output of the engine rotatingly drives the cutting blade via the drive belt. The drive belt is driven via a centrifugal clutch which enables the output drive spindle of the engine to disengage from the belt when the engine is running at a slow speed, to allow the engine to continue running, whilst allowing the blade to be stationary.

Also mounted in the housing is a gasoline tank which provides gasoline for the engine via a carburetor. An oil tank can also be provided, which provides lubricating oil to mix with the gasoline, to lubricate the engine.

Mounted on the rear of the housing is a rear handle for supporting the power cutter, which contains a trigger switch for accelerating the engine upon depressing. Depression of the trigger switch causes more of the aerated gasoline/oil mixture to be injected into the engine which in turn causes the speed of the engine to accelerate.

GB2232913 and WO2005/056225 show such power cutters.

Power cutters are typically started using a pull cord. Once started, the engine will continue to run in an idle mode until stopped. It is important to provide a switching mechanism which prevents the power cutter from being started when it is the OFF position, and which allows it to be started when it is in the ON position. The switching mechanism is also used to stop the engine when it is running by being switched from its ON position to its OFF position. However, it is desirable to be able to switch the engine off quickly during an emergency situation. Switches on existing designs do not provide for rapid operation and therefore the switching off operation of the engine can be slow and/or complicated, which is not desirable.

BRIEF SUMMARY OF THE INVENTION

The present invention provides a switching mechanism which has a facility for being more rapidly switch to its OFF position.

According to a first aspect of the present invention there is provided a switch mechanism for a power tool switchable between an ON and OFF state including a support structure. A first actuator is rotatably mounted on the support structure and is rotatable between a first position and a second position.

The first actuator is releasably latchable in either of the first or second positions. The first actuator includes a recess. A second actuator is a slidable button located inside of the recess of the first actuator so that the first actuator at least partially surrounds the second actuator, and is linearly slidable within the recess between a first position and a second position. The second actuator is biased towards its first position. Movement of the first actuator from its first position to its second position, when the second actuator is in its first position, switches the switching mechanism to its ON state; and movement of the first actuator from its second position to its first position, when the second actuator is in its first position, switches the switching mechanism to its OFF state. Movement of the second actuator from its first position to its second position, when the first actuator is latched in its second position, switches the switch mechanism to its OFF state.

According to a second aspect of the present invention there is provided a power tool including a switch mechanism wherein 1) when the switch mechanism is in the ON state and the power tool is deactivated, the power tool is able to be activated, and; 2) when the switch mechanism is in an OFF state and the power tool is deactivated, the power tool is prevented from being activated, and; 3) when the switch mechanism is switched from the ON state to the OFF state when the power tool is activated, the power tool is deactivated.

The power tool can be a power cutter.

BRIEF DESCRIPTION OF THE DRAWINGS

An embodiment of the present invention will now be described with reference to the accompanying drawings of which.

DETAILED DESCRIPTION OF THE INVENTION

Figure 1:
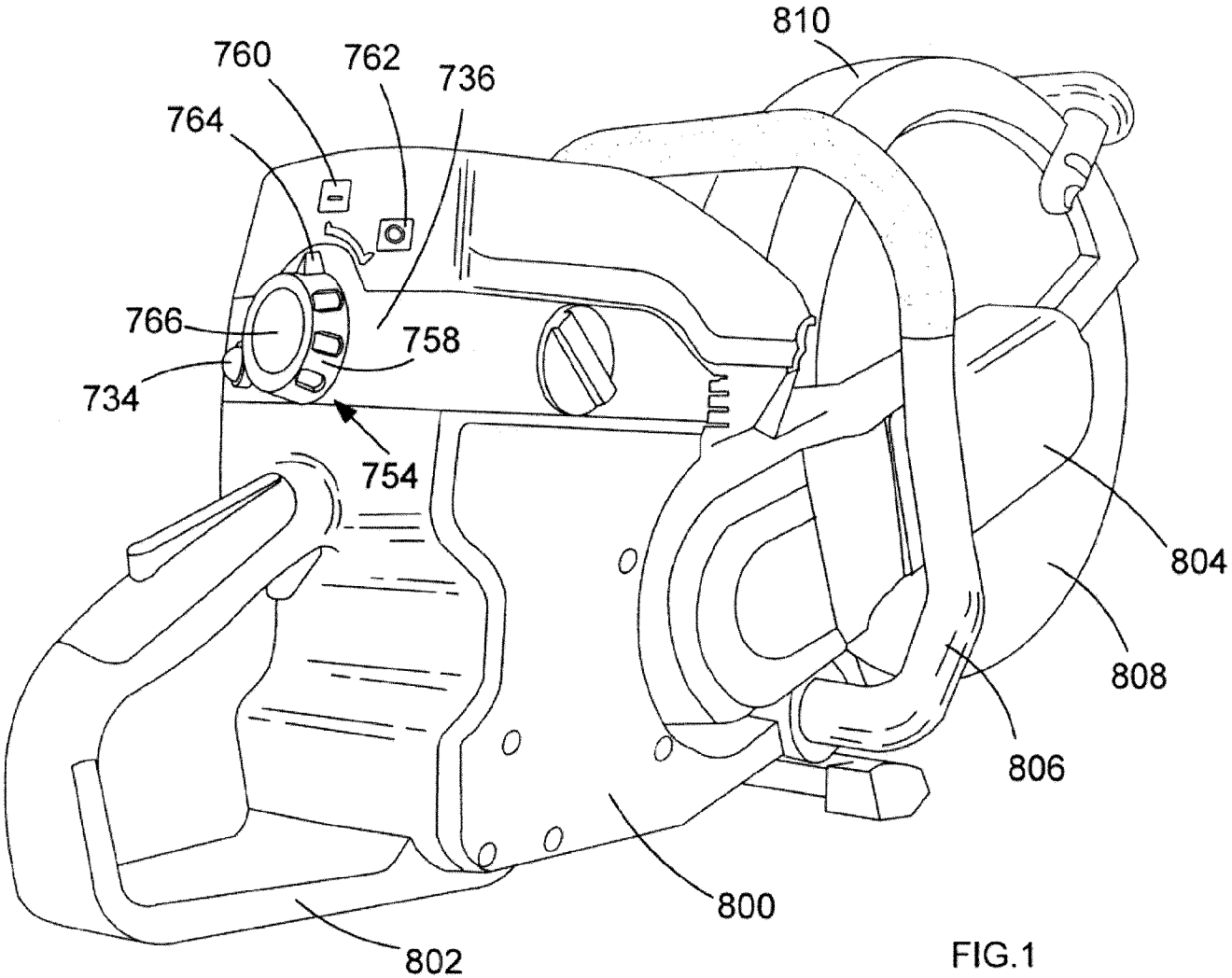
FIG. 1 illustrates a rear perspective view of the power cutter.

FIG. 1 shows a power cutter which includes a housing 800 in which is located a two stroke engine, a rear handle 802, a support arm 804 and a front handle 806. A cutting blade 808 is rotatably mounted on the support arm and which can be driven by the engine. A guard 810 surrounds the top part of the blade 808.

Figure 2:
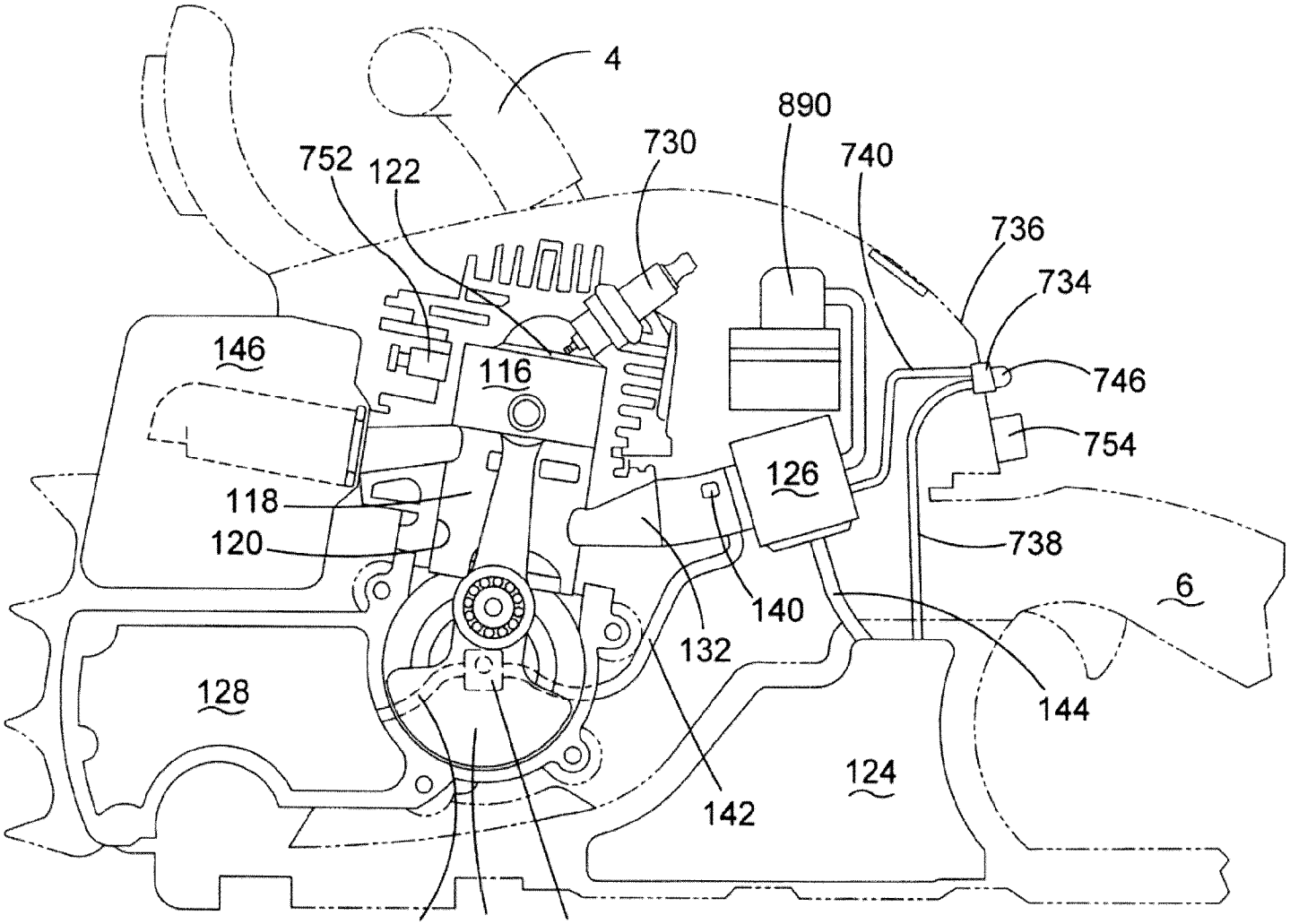
FIG. 2 illustrates a schematic view of the engine of the power cutter.

Referring to FIG. 2, the two stroke internal combustion engine is fed with an air/gasoline mixture from a carburetor 126. The engine burns the mixture in well known manner to generate rotary motion of its crank shaft 114, which connects to an output shaft. The exhaust gases are then expelled from the engine through an exhaust 146 to the surrounding atmosphere. The engine is started using a pull cord in well know manner.

The power cutter will include a gasoline tank 124 in which is located gasoline for driving the two stroke internal combustion engine 24. Gasoline will pass from the tank 124 via passageway 144 through the carburetor 126 which will mix it with air from an air filter 890, prior to being forwarded to the cylinder 120 where it will be burnt. A second tank 128 will also be mounted in the body as shown in which lubricating oil will be contained. The oil will be pumped out of the tank 128 via an oil pump 700. The oil pump 700 will pump the oil through the oil passageways indicated by lines 142 from the oil tank 128 via the pump 130 into the passageway 132 between the carburetor 126 and the cylinder 120, in a suitable form, for example, as a spray or atomized, which is then mixed with the air/gasoline mixture generated by the carburetor 126. A sensor 140 is mounted within the passageway 132 between the carburetor 126 and cylinder 120. The sensor monitors the amount of oil being added to the gasoline/air mixture and sends a signal, via an electric cable 701, indicative of the amount of oil in the passageway 132 back to an electronic controller 716 (see FIG. 3). Such a sensor can be of a capacitance type whereby the sensor monitors the change in capacitance between two plates, the capacitance being a function of the amount of oil there is in the gasoline/air mixture.

The carburetor 126 is a standard design which, during normal operation, operates with out any external power input. However, the carburetor 126 includes a solenoid 714. There are a number of ways a carburetor can use a solenoid, two of which are:

Firstly, the solenoid can open a channel within the carburetor which allows the gasoline to get direct access to the passageway leading to the cylinder. This provides the engine with an air/gasoline mixture which is richer in gasoline.

Secondly, the solenoid can close an air channel within the carburetor, which passes clean air around the carburetor to the passageway. With the airflow closed by the solenoid (or substantially closed), the air/gasoline mixture is richer in gasoline.

The solenoid is used when the engine is cold to provide an air/gasoline mixture which is richer in gasoline to help start the engine. When the engine is warm, the solenoid is either not utilized or is switched off. The temperature of the engine is measure using a sensor 710 located on the engine block. The solenoid 714 is used to replace the choke on the carburetor whereby which an operator would manually adjust the valve to start the engine when it is cold.

An example of a carburetor which uses a solenoid in such a manner is disclosed in U.S. Pat. No. 7,264,230.

Figure 3:
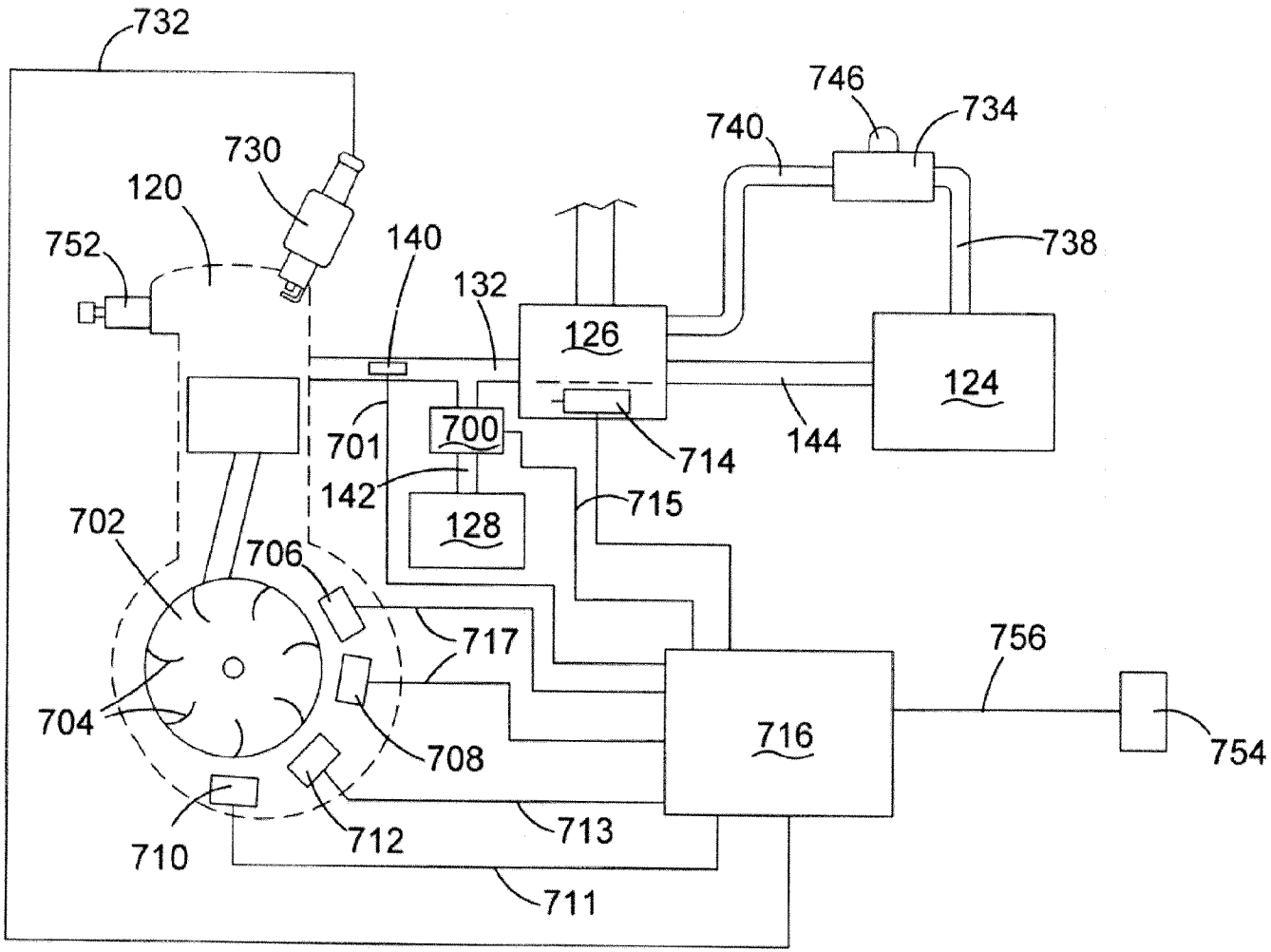
FIG. 3 illustrates the control system for the engine.

The engine ignition system is controlled by an electronic controller 716, the function of which is described in more detail below with reference to FIG. 3.

Mounted on the end of the end of the crank shaft 114 is a fly wheel 702 which contains a number of metal fins 704 which form an impeller. As the fly wheel 702 rotates, the impeller blows air around the outside of the engine. Adjacent the impeller 702 are two generators 706, 708. The two generators generate electricity using magnets and the change of inductance caused by the rotating flywheel 702. As the fly wheel 702 rotates, it causes the two generators 706, 708 to produce electricity. The first generator 706 is used to provide electricity for the ignition system of the engine and the electronic controller 716. The second generator 708 is used to provide electricity for the oil pump 700 and the solenoid 714 in the carburetor. Both are connected to the electronic controller 716 via cables 717. The two generators 706, 708 will be off-the-shelf products.

Also mounted adjacent the flywheel are two sensors 710, 712. The first sensor 710 monitors the temperature of the engine block and sends a signal via an electric cable 711 indicative of the temperature to the electronic controller 716. The second sensor 712 monitors the angular position of the flywheel 702 and sends a signal via an electric cable 713 indicative of the angular position of the flywheel 702 back to the electronic controller 716. This signal can also be used by the electronic controller 716 to determine the rate of rotation of the fly wheel 702, as well as its angular position.

Figure 4:
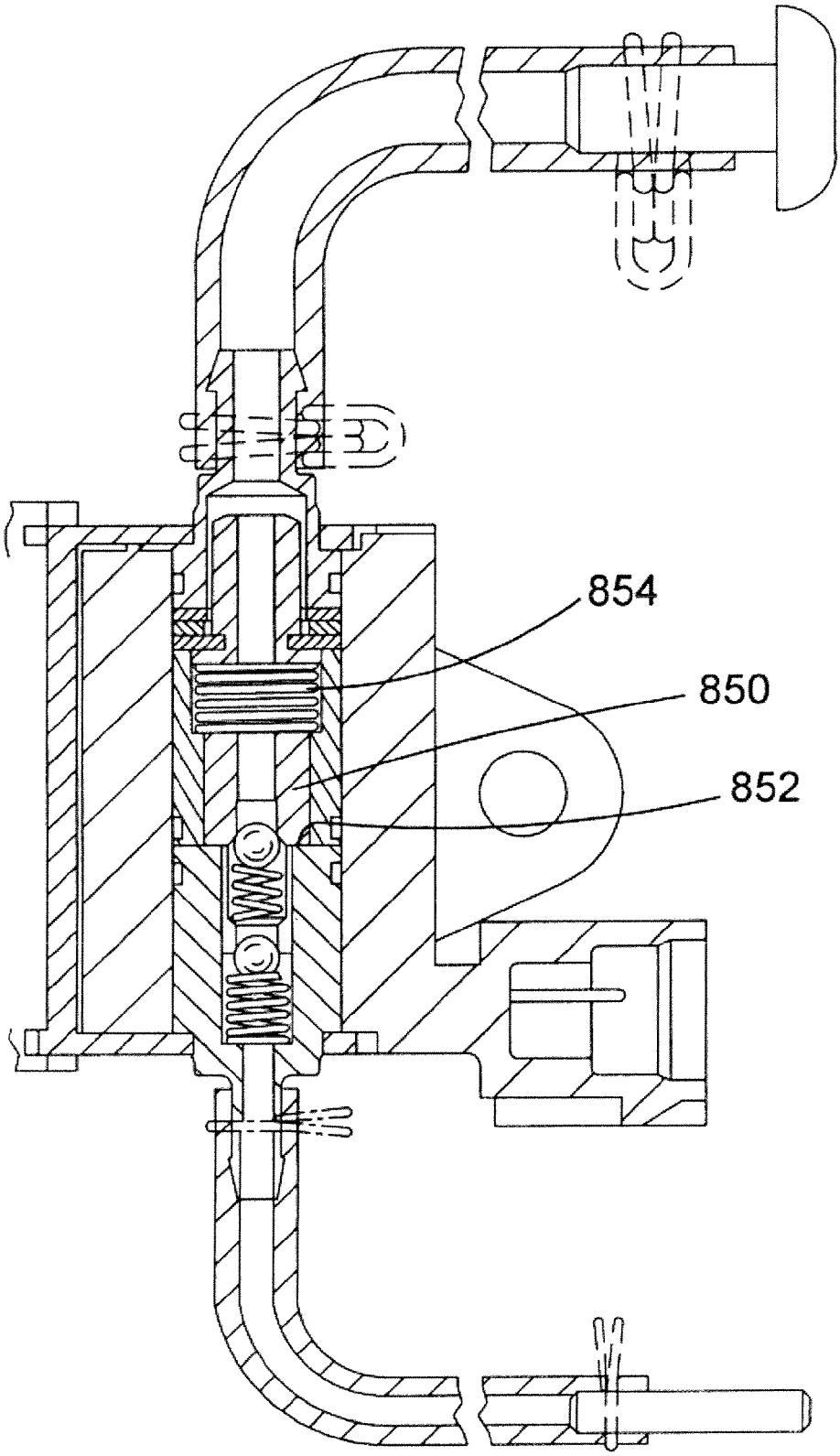
FIG. 4 illustrates the oil pump.
Figure 14A:
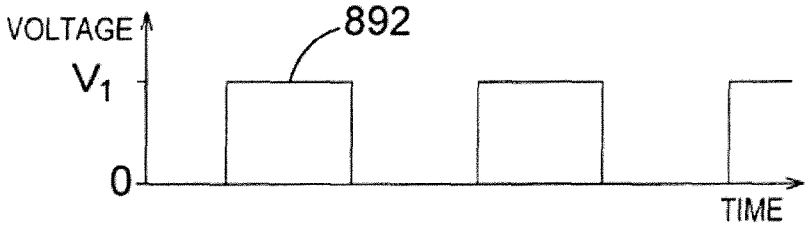
FIGS. 14A and 14B illustrate the electric signal sent to the oil pump from the electronic controller operating at two speeds, a slow speed (FIG. 14A) and a high speed (FIG. 14B).
Figure 14B:
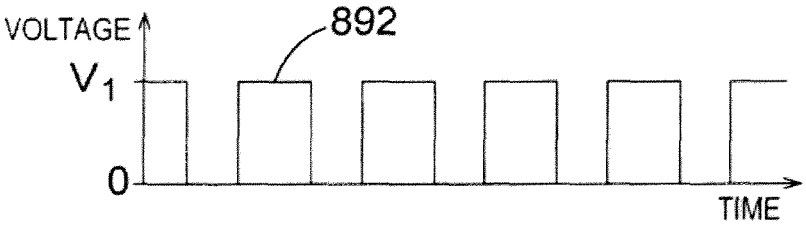

The oil pump 700 is an electrically powered oil pump 700, the power for which is supplied by the electronic controller 716 via electric cable 715. The oil pump is shown in FIG. 4. This type of oil pump is described in EP1236894 and therefore further explanation of its construction will not be described in detail. The oil pump 700 is driven by the electronic controller 716 which sends a square shaped voltage signal 892 to the oil pump (see FIG. 14A) When the voltage is at V1, the electric controller 716 causes the piston 850 of the pump to move, reducing the size of the oil chamber 852. This causes a preset amount of oil to be pumped out of the chamber 852. When voltage is "0", the piston returns to its starting position due to a spring 854, enlarging the chamber 852 and allowing the chamber 852 to fill with oil. The higher the frequency of the square shaped voltage signal 892, the more oil the oil pump 700 pumps per unit of time. The oil pump is capable of running at two speeds (the first speed shown in FIG. 14A, the second speed being shown in FIG. 14B where the frequency of the square shaped volge signal 892, and hence the movement of the piston 850, is double). The general operation of the oil pump is described in more detail below.

A spark plug 730 is connected to the electronic controller 716 via a cable 732. Ignition of the spark plug is controlled by the electronic controller 716.

Figure 5:
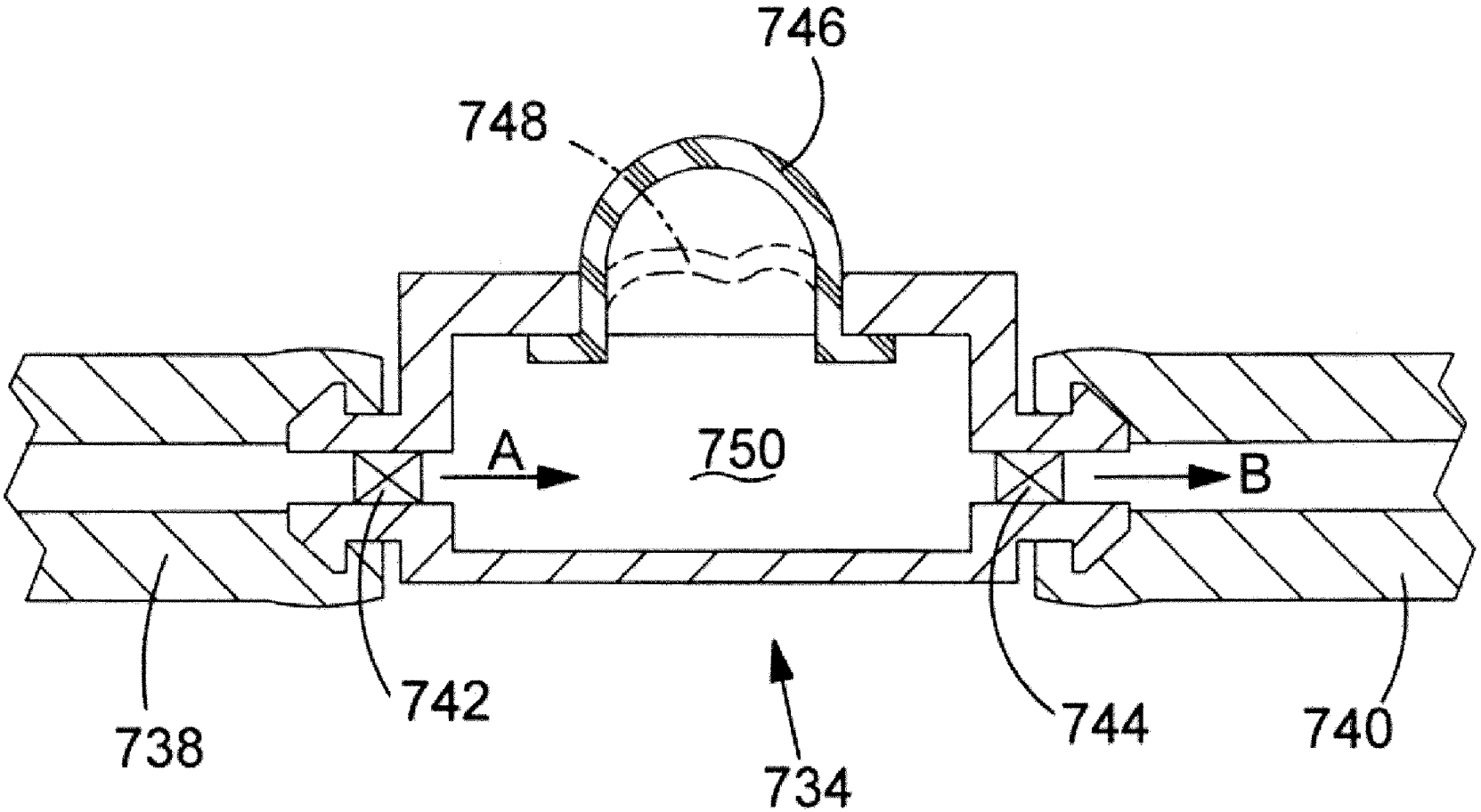
FIG. 5 illustrates the primer.
Figure 11:
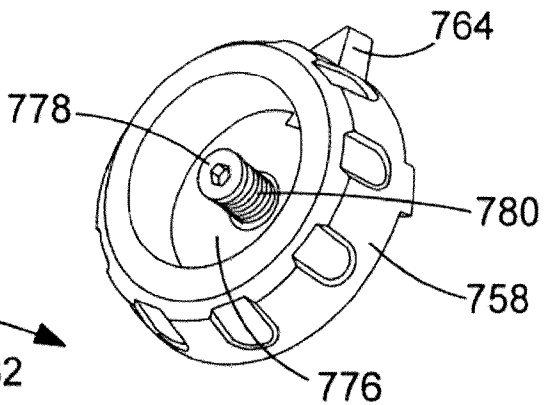
FIG. 11 illustrates the knob, bolt and spring.

A primer 734 is mounted on the rear wall 736 of the housing 800 of the power cutter. The primer is a manual pump. A pipe 738 connects from the gasoline tank 124 to the primer 734. A second pipe 740 connects from the primer to the carburetor 126. A brief description of the principle of how the primer works will now be described with reference to FIG. 5. The primer includes two valves 742, 744 located in series which allow the gasoline to flow one way through them only (indicated by Arrows A and B). Located between the two valves 742; 744 is a chamber 750 having a rubber dome 746 forming a wall which is accessible to the user of the power cutter. One valve 742 only allowing gasoline to enter the chamber 750, the other only allowing gasoline to leave the chamber 750. In order to use the primer, the operator, compresses the rubber dome 746 (shown as dashed lines 748). This reduces the amount of volume in the chamber 750 formed between the valves and hence the amount of space which can contain gasoline. As such, gasoline is ejected from the primer through the one of the valves 744, as the second valve 742 remains closed, preventing gasoline from leaving the chamber 750 via that valve 742. When the operator releases the dome 746, the volume of the chamber 750 increases, causing gasoline to be sucked into the chamber 750 through the second valve 742 as the first valve remains closed 744 preventing gasoline from entering the chamber 750 through that valve 744. Repetitive compressing and releasing of the dome 746 results in the gasoline being pumped through the primer 734. The primer is arranged so that the operator can manually pump the gasoline from the tank 124 to the carburetor 126 through the pipes 738, 740.

The purpose of the primer is to enable the operator to place gasoline into the carburetor. Otherwise the operator has to spin the engine a number of times using the pull cord before a sufficient amount of gasoline is sucked through into the carburetor 126.

A DECO valve 752 is mounted on the side of the cylinder 120. The valve 752 is opened manually by the operator prior to starting the engine. When opened, the DECO valve reduces the pressure within the cylinder 120 prior to ignition. This enables the starting of the engine using the pull cord to be made easier as the amount compression of the gasoline/air mixture required is reduced. When the engine is started, the DECO valve automatically closes.

The electronic controller 716 has an on/off switch 754 in the form of a rotatable knob 758. The switch is connected to the electronic controller via an electric cable 756.

The knob 758 has a pointer 764 integrally formed on its periphery. The rotatable knob 758 has two angular positions between which it can rotate. In the first position, the switch is ON. In this position, the pointer 764 points to an ON label 762 (see FIG. 1). In the second position, the switch is OFF. In this position, the pointer 764 points to an OFF label 760. When the rotatable knob is in the ON position, the operator can start the engine and use the power cutter. When the rotatable knob 758 is in the OFF position, the engine is prevented from being started. If the rotatable knob 758 is moved from the ON to the OFF position when the engine is running, the engine is automatically switched off.

A stop button 766 is located in the centre of the knob 758. If the engine is running (i.e. the knob is in the ON position), depression of the stop button 766 will result in the engine being switched off. The knob 758 then automatically returns to the OFF position. If the knob 758 is prevented from returning to the OFF position after the stop button has been depressed, the engine will not be able to be started until the knob 758 has been allowed to return to the OFF position.

The construction of the assembly for the ON/OFF switch 754, which includes the knob 758 and stop button 766, will now be described.

The ON/OFF switch assembly includes the rotatable knob 758, a crank 768, a switch cam 770 and the stop button 766.

The crank 768 is rigidly fixed into the rear wall 736 of the housing 800 and prevented from rotation. The crank 768 includes a socket 772 into which is rigidly mounted a micro switch 774 (see FIG. 8C).

Rotatably mounted on the outside of the crank 768 is the knob 758. Rotatably mounted on the inside of the crank 768 is the switch cam 770. A bolt 778, which passes through the base of a tubular recess 776 formed in the knob 758, screws into the switch cam 770 and is rigidly attached to it. Sandwiched between the head of the bolt 778 and the base of the recess 776 is a spring 780. The bolt 778 and spring 780 hold the knob 758 and switch cam 770 onto the crank 768, biasing them towards each other as the spring biases the head of the bolt 778 away from the base of the recess 776. The knob can rotate through a limited range of movement (between the ON and OFF positions) relative to the crank 768. The range of positions is limited by pegs 786 formed on the underside of the knob engaging with recesses 788 formed in the edge of the rear wall 736 of the housing. The switch cam 770 can also rotate through a limited range of movement relative to the crank 768. In addition, the switch cam 770 can axially slide relative to the crank 768 in a direction parallel to the longitudinal axis of the bolt 778 over a limited range of movement, the range being limited by the length of the bolt 778 within the recess 776. The bolt 778 rotates and slides with the switch cam 770.

Figure 9:
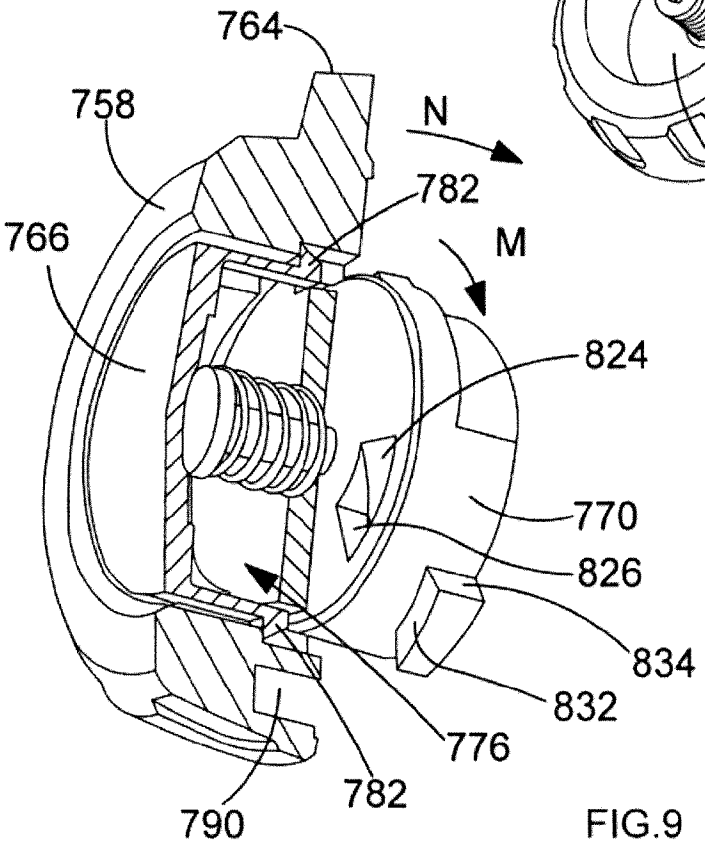
FIG. 9 illustrates a cut away view of the switch.

The stop button 766 is mounted within the tubular recess 776 formed in the knob 758 and encloses the end of the bolt 778 located in the recess 776 and the spring 780 (see FIG. 9). The stop button 766 can axially slide within the recess 776 towards or away from the switch cam 770. The range of outward axial movement of the stop button is limited by stops 782 each engaging with an inner step of the knob 758. The head of the bolt 778 directly abuts the underside of the stop button 766. Depression of the stop button causes the bolt 778 to be pushed through the base, compressing the spring 780, moving the switch cam 770 away from the crank 768 and knob 758.

Figure 10:
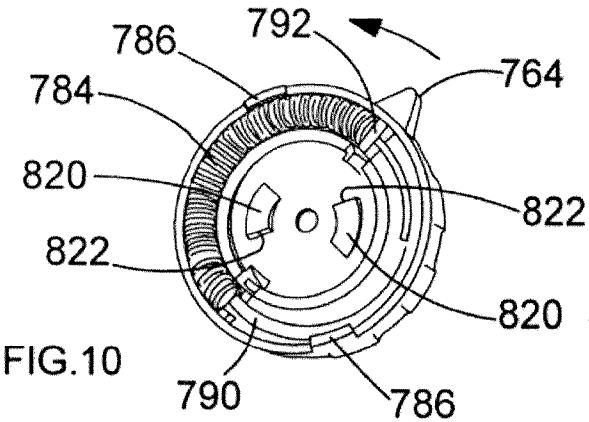
FIG. 10 illustrates the underside of the knob.
Figure 6:
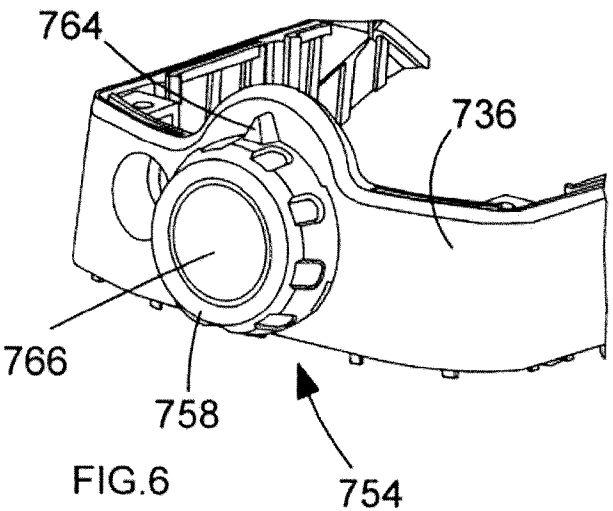
FIG. 6 illustrates the rotatable on/off switch.
Figure 7:
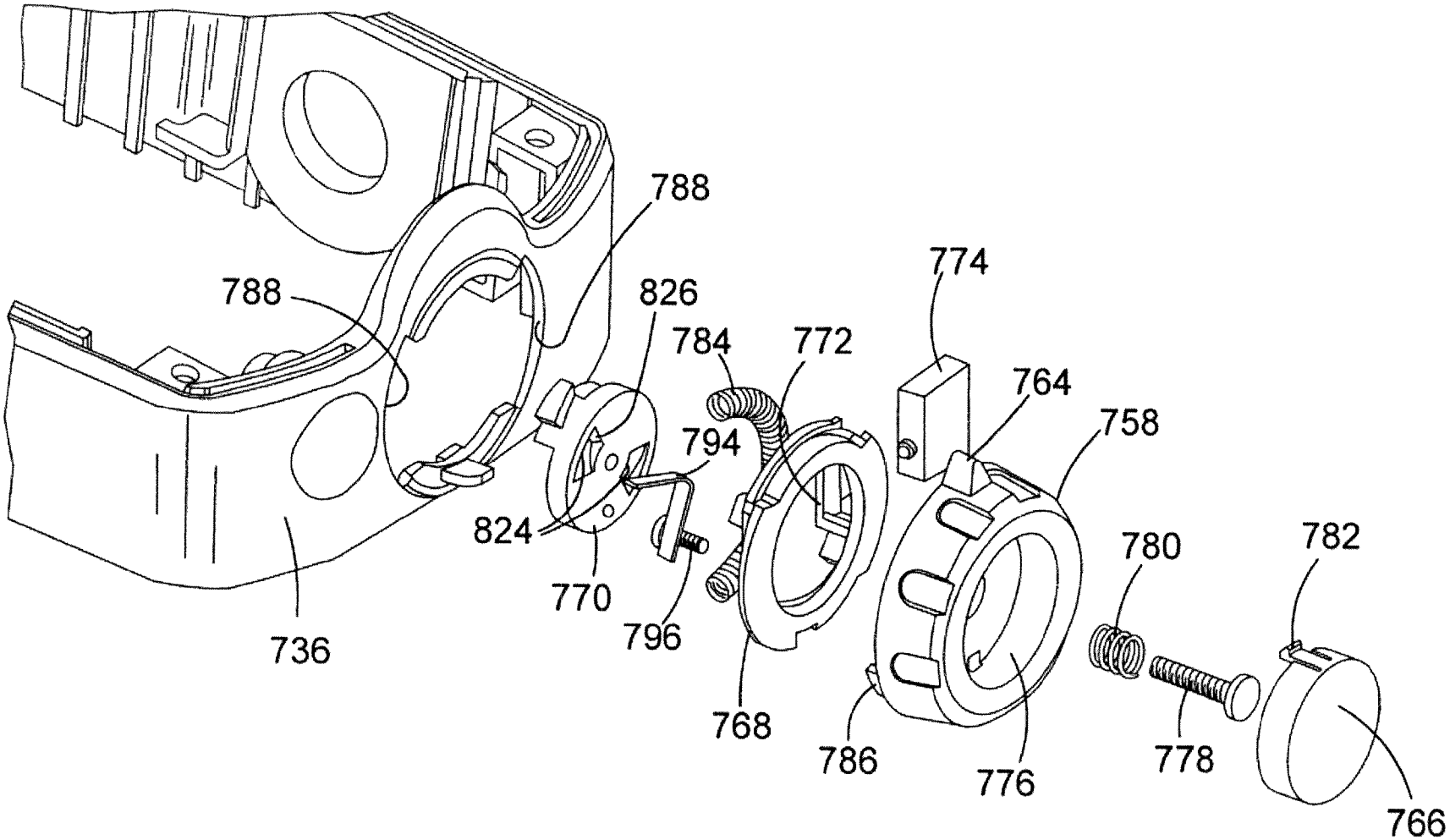
FIG. 7 illustrates an exploded view of the switch.

Connected between the knob 758 and the crank 768 is a long helical spring 784. The helical spring 784 locates in a circular channel 790 formed on the underside of the knob 758 as best seen in FIG. 10. One end abuts against a wall 792 at the end of the channel 790. The other end abuts against a stop (not shown) formed on the crank 772. The spring 784 rotationally biases the knob 758 relative to the crank to its OFF position.

Figure 12:
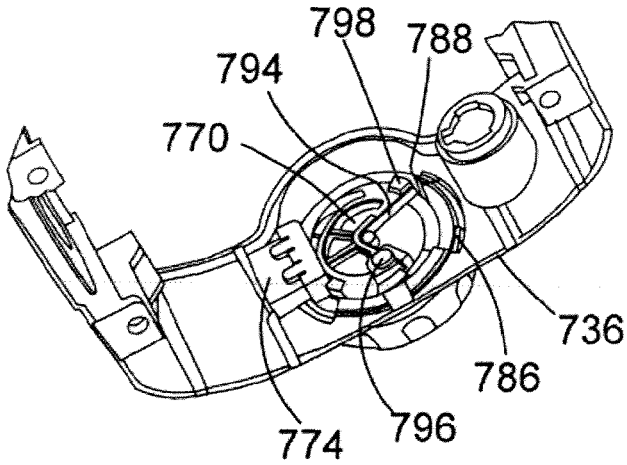
FIGS. 12 and 13 illustrate rear views of the switch.
Figure 13:
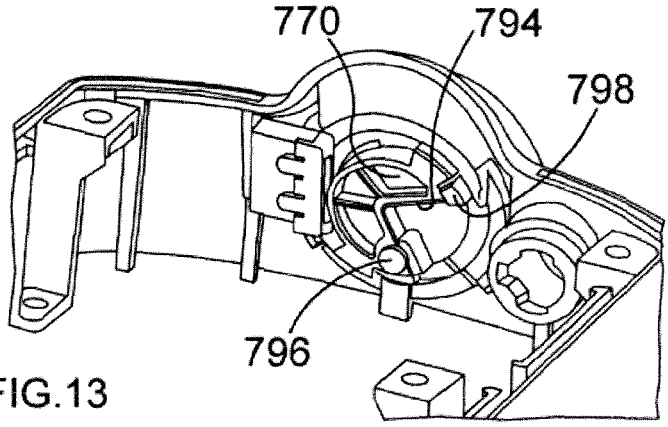

Connected between the switch cam 770 and the crank 768 is a leaf spring 794 as best seen in FIGS. 12 and 13. One end of the leaf spring 794 is connected using a small bolt 796 to the switch cam 770. The other end abuts a stop 798 on the crank 768. The leaf spring 794 rotationally biases the switch cam 770 relative to the crank to an OFF position.

Formed on the underside of the knob 758 are two ramps 820, each ramp having a ramp end 822 as best seen in FIG. 10. Formed on the side of the switch cam 770 which faces the knob 758 are ramp recesses 824 which have ramp recess ends 826 as best seen in FIG. 9. When the switch assembly is in the OFF position i.e. when both the knob 758 and the switch cam 770 in their OFF positions under the biasing force of their respective springs 784, 794, each of the two ramps 820 is located in a corresponding ramp recess 824 with the ramp ends 822 of each ramp 820 abutting directly against the ramp recess ends 826 of the corresponding ramp recess 824.

Figure 8A:
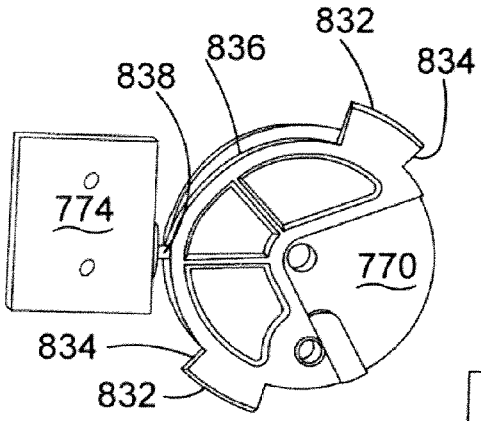
FIGS. 8A to 8E illustrate the switch cam and micro switch.
Figure 8B:
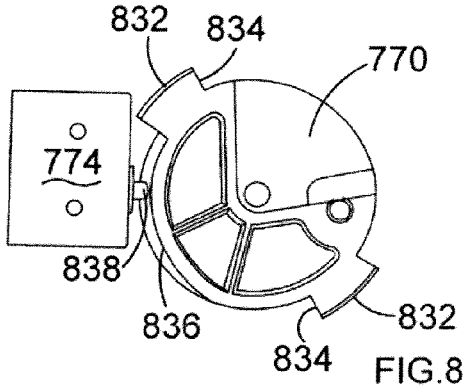
Figure 8C:
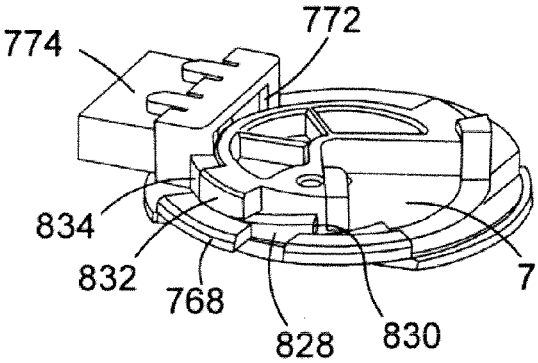

Formed on the underside of the crank 768 are two crank ramps 828, each ramp 828 having a crank ramp end 830 as best seen in FIG. 8C. Formed on the side of the switch cam 770 which faces the knob 758 are switch cam crank ramps 832 which have switch cam crank ramp ends 834 as best seen in FIG. 9. When the switch assembly is in the OFF position i.e. with both the knob and the switch cam 770 in their OFF positions under the biasing force of their respective springs 784, 794, each of the two switch cam crank ramps 832 are located against the low end (the end of the crank ramp 828 away from the crank ramp end 830) of the corresponding crank ramp 828 as shown in FIG. 8C.

Formed around the edge of the switch cam 770 is a peripheral cam 836 as best seen in FIGS. 8A and 8B. The micro switch 774 includes a pin 838 which projects from the body of the micro switch 774. The pin 838 is axially slidable in or out of the body of the micro switch 774 and biased to its outer most position by a spring (not shown) inside the micro switch 774. The pin 838 engages the peripheral cam 836. Rotation of the switch cam 770 causes the pin 838 to slide along the peripheral cam 836, which causes it to be pushed into the body of the micro switch 774 against the biasing force of the spring, or allows it to slide out of the body of the micro switch 774 under influence of the spring. When the switch cam 770 is in its OFF position, the pin is pushed into the body of the micro switch 774 as shown in FIG. 8A. When switch cam is rotated to its ON position, the pin 838 extends to its outer most position as shown in FIG. 8B.

The way the assembly for the ON/OFF switch works will now be described.

Figure 8D:
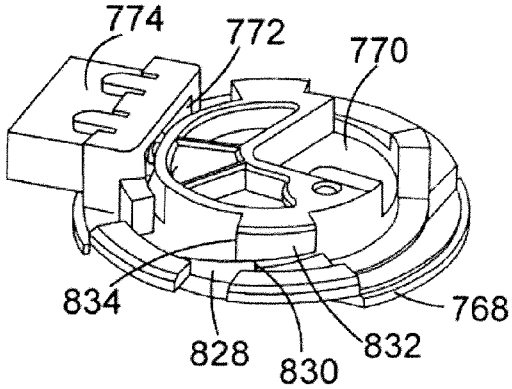
Figure 8E:
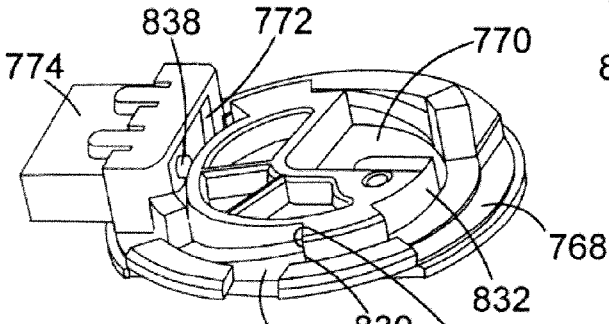

Initially, the knob 758 and the switch cam 770 are both located in their OFF positions. The operator of the power cutter desires to turn the unit on using the ON/OFF switch. The operator uses their hand to rotate the knob 758 from its OFF position to its ON position. When the knob 758 is rotated, it causes the cam switch 770 to rotate in unison as the rotary movement is transferred from the knob 758 to switch cam 770 by the ramp ends 822 of each ramp 820 pushing the ramp recess ends 826 of each corresponding ramp recess 824, against which it abuts, in the direction of Arrow M in FIG. 9, to cause the switch cam 770 to rotate with the knob 758. As the switch cam 770 rotates, the two switch cam crank ramps 832, which are initially located against the low end of the crank ramps 828 (shown in FIG. 8C), ride up the crank ramps 828 (shown in FIG. 8D), which are stationary. As the switch cam crank ramps 832 ride up the crank ramps 828 due to the rotation of the switch cam 770, the switch cam 770 is forced to axially slide away from the knob 758 (direction of Arrow N in FIG. 9), causing the spring 780 to be compressed and the head of the bolt 778 to move towards the base of the recess 776. When the switch cam has rotated sufficiently that the crank ramp ends 830 and the switch cam crank ramp ends 834 become aligned, the switch cam 770 axially slides under the biasing force of the spring 780 towards the knob 758, ensuring that the crank ramp end 830 and the switch cam crank ramp ends 834 abut against each other as shown in FIG. 8E. When the crank ramp ends 830 and the switch cam crank ramp ends 834 abut each other as shown in FIG. 8E, the switch cam 770 is in its ON position and is prevented from returning to its OFF position, under the influence of the leaf spring 794, as the crank ramp ends 830 and the switch cam crank ramp ends 834 prevent relative movement as they are jammed against each other. The knob 758 is prevented from returning to its OFF position under the influence of the spring 784 by the ramps 820 being held within the ramp recesses 824 by the action of the spring 780 which overrides the spring 784. When the switch cam 770 rotates from the OFF position (see FIG. 8A) to the ON position (FIG. 8B), the peripheral cam 836 rotates, which in turn allows the pin 838 to extend from the body of the micro switch 774. This in turn makes a connection which allows the electric controller 716 to activate the power cutter and allow it to start when the pull cord is pulled.

As such, the assembly of the ON/OFF switch is now ON with the knob 758 and the switch cam 770 both in their ON positions, allowing the pin 838 to extend from the body of the micro switch 774. There are two way of switching the ON/OFF switch assembly to its OFF position.

The first method includes the depression of the stop button 766. Depression of the stop button 766 causes the head of the bolt 778 to slide towards the base of the recess 776 of the knob 758, compressing the spring 780, which in turn causes the switch cam 770 to axially slide away from the knob 758. As the switch cam 770 axially slides, the switch cam 770 moves away from the crank 768, which in turn causes the crank ramps 828 and the switch cam crank ramps 832 to move away from each other, and thus causes the crank ramp ends 830 and the switch cam crank ramp ends 834 to disengage. As such, the switch cam 770 can now rotate back to its OFF position under the influence of the leaf spring 794. As the knob is held in its ON position by the ramps 820 being held within the ramp recesses 824, the knob 858 will also return to its OFF position as the ramp recesses 824 rotate with the switch cam 770. Should the ramps 820 become disengaged from the ramp recesses 824 due to the sliding movement of the switch cam 770 relative to the knob 758, the knob 758 will return to its OFF position under the influence of the spring 784 between the knob 758 and the crank 768.

The second method of switching the ON/OFF switch assembly OFF includes the rotation of the knob 758. The operator rotates the knob 758 to its OFF position. As the ramps 820 are held within the ramp recesses 824, rotation of the knob 758 urges rotation of the switch cam 770. However, the switch cam 770 is prevented from rotating as the crank ramp ends 830 and the switch cam crank ramp ends 834 abut each other. Therefore, the ramps 820 slide out of the ramp recesses 824, the ramp ends 822 moving away from ramp recess ends 826. As the ramps 820 slide out of the ramp recesses 824, the switch cam 770, which is prevented from rotating, axially slides away from the knob 858 by the camming action of the ramps 820 and ramp recesses 824. When the switch cam 770 has slid sufficiently far enough away from the knob 758, the crank ramp ends 830 and the switch cam crank ramp ends 834, which are sliding away from each other, become disengaged. Thus the switch cam 770 can rotate under the influence of the leaf spring 794 to its OFF position. The knob 758 will move under the influence of the operator and/or the spring 784. As such, both the knob 758 and the switch cam 770 return to their OFF position where they are held by the springs 784, 794.

When both the knob and switch cam 770 moved to their OFF positions, the ramps 820 engage with the ramp recesses 824 so that the switch can be used again to switch on the power cutter.

The operation of the power cutter will now be described.

The operator first activates the DECO valve 752 and then pumps some gasoline into the carburetor 126 using the primer 734. The operator then switches the ON/OFF switch to ON by rotation of the knob 758 to its ON position. The operator then pulls the pull cord to rotate the crank 114 of the engine. As the crank 114 rotates, the fly wheel 702 also rotates causing the two generators 706, 708 to produce sufficient electricity to operate the power cutter.

The electronic controller checks the temperature of the engine using sensor 710. If the engine is cold, the electronic controller uses the electricity from the second generator 708 to power the solenoid 714 in the carburetor to set the "automatic choke". The second generator 708 is not powerful enough to power both the oil pump 700 and solenoid 714 at the same time. Therefore, when the electronic controller 716 is operating the solenoid 714, it switches off the oil pump 700. It has been found that the period during which lubricating oil is not required before the engine is damaged is greater than that required to heat up the engine.

The electronic controller supplies the power to the spark plug to cause combustion in the engine, the power being provided by the first generator 706, the timing being determine by the electronic controller 716 based on the signal provided by the sensor 712 in relation to the angular position of the fly wheel 702.

Once the engine commences firing, the DECO valve automatically closes. The electronic controller 716 continues to monitor the engine temperature and when it has reached a predetermine temperature, the electronic controller 716 switches the solenoid 714 in the carburetor 126 off. The electronic controller 716 then commences supplying a square shape voltage signal to the oil pump to commence pumping oil. The electronic controller monitors the speed of the engine using the signal provided by the sensor 712 monitoring the angular position of the fly wheel 702 to calculate the rotational speed. If the rotational speed is below a predetermined value, the electronic controller 716 sends a signal (FIG. 14A) to the oil pump 700 to cause it to pump at a slow speed. If the rotational speed is above a predetermined value, the electronic controller 716 sends a signal (FIG. 14B) to the oil pump 700 to cause it to pump at a higher speed. The speed of the engine is dependent on the operator squeezing a trigger switch which connects to the carburetor via a cable.

While the engine is running the electronic controller 716 monitors the oil being added to the gasoline/air mixture using the sensor 140. If the sensor 140 detects that the rate of flow of the oil being pumped by the oil pump 700 has dropped below a predetermine amount (e.g. there is a blockage in the oil pipe 142 or the tank 128 is empty), the electronic controller places the engine into an idle mode using the ignition system so that the engine runs, but at a minimal rate. The operator can not speed up the engine using the trigger until the sensor 140 detects the flow of oil. This protects the engine from damage due to a lack of lubrication. It has been found that the engine can run in idle mode for a considerable period of time before damage to the engine results.

In order for the operator to stop the power cutter, the operator either depresses the stop button 766 or rotates the knob 758 to its OFF position.

I claim:

1. A switch mechanism for a power tool switchable between an ON and OFF state comprising: a support structure;

a first actuator rotatably mounted on the support structure and which is rotatable between a first position and a second position, wherein the first actuator is releasably latchable in at least one of the first and second positions;

wherein the first actuator comprises a recess;

a second actuator, which is a slidable button located inside of the recess of the first actuator so that the first actuator at least partially surrounds the second actuator, and which is linearly slidable within the recess between a first position and a second position, the second actuator being biased towards its first position;

wherein movement of the first actuator from its first position to its second position, when the second actuator is in its first position, switches the switching mechanism to its ON state;

wherein movement of the first actuator from its second position to its first position, when the second actuator is in its first position, switches the switching mechanism to its OFF state; and wherein movement of the second actuator from its first position to its second position, when the first actuator is latched in its second position, switches the switch mechanism to its OFF state.

2. A switch mechanism as claimed in claim 1, wherein the first actuator is biased towards its first position and, when the second actuator is moved from its first position to its second position when the first actuator is latched in its second position, the first actuator is caused to return to its first position due to the biasing force acting on it.

3. A switch mechanism as claimed in claim 1, further comprising a switch cam rotatably mounted on the support structure and which is rotatable between a first angular position and a second angular position, and which is angularly biased towards its first angular position; the switching mechanism being in its ON state when the switch cam is in its second angular position, wherein the first actuator is rotationally connected to the switch cam so that, when the first actuator is in its first position and the switch cam is in its first angular position, rotation of the first actuator from its first position to its second position causes the switch cam to rotate from its first angular position to its second angular position.

4. A switch mechanism as claimed in claim 3, wherein the switch cam is also slidably mounted on the support structure and is slidable between a first axial position and a second axial position, the switch cam being axially biased towards its first axial position, wherein, there is further provided at least one first ramp on the first actuator and a corresponding at least one first ramp on the switch cam, and wherein, when the first actuator is in its first position and the switch cam is in its first angular position, the at least one first ramp on the first actuator is biased into engagement with the at least one first ramp on the switch cam by the biasing force acting on the switch cam to axially bias it towards its first axial position, wherein rotation of the first actuator from its first position to its second position causes the switch cam to rotate from its first angular position to its second angular position due to the transfer of the rotary drive via the ramps.

5. A switch mechanism as claimed in claim 4, wherein when the first actuator is in its first position and the switch cam is in its first angular position, the end of the at least one first ramp on the first actuator is engaged with the end of the corresponding at least one first ramp on the switch cam, the rotary force being transferred via the ends; of the ramps; when the first actuator is rotated from its first position to its second position to rotate the switch cam from its first angular position to its second angular position.

6. A switch mechanism as claimed in claim 5, further comprising at least one second ramp on the switch cam and a corresponding at least one first ramp on the support structure wherein, when the switch cam is in its first axial and angular positions, the at least one second ramp on the switch cam is biased into engagement with the corresponding at least one first ramp on the support structure by the biasing force acting on the switch cam to axially bias the switch cam towards its first axial position, wherein rotation of the switch cam from its first angular position towards its second angular position causes the at least one second ramp on the switch cam to ride up the corresponding at least one first ramp on the support structure, which in turn causes the switch cam to slide from its first axial position towards its second axial position.

7. A switch mechanism as claimed in claim 6, wherein the at least one second ramp on the switch cam and the corresponding at least one first ramp on the support structure both comprise stops, wherein, when the switch cam reaches its second angular position, the stops; become aligned, allowing the switch cam to axially slide to its first axial position due to its axial biasing force, resulting the stops; abutting each other and angularly locking the switch cam in its second angular position.

8. A switch mechanism as claimed in claim 7, wherein when the switch is locked in its second angular position, its holds the first actuator in its second position due to the interaction of the at least one ramp on the first actuator and the at least one first ramp on the switch cam.

9. A switch mechanism as claimed in claim 8, wherein when the first actuator is in its second position and the switch cam is in its second angular and first axial positions, rotation of the first actuator from its second position to its first position causes the switch cam to rotate from its second angular position to its first angular position.

10. A switch mechanism as claimed in claim 9, wherein when the first actuator is in its second position and the switch cam is in its second angular and first axial positions and the first actuator is rotated from its second position to its first position, the at least one ramp on the first actuator rides up the at least one ramp on the angularly locked switch cam, causing the switch cam to slide from its first axial position to its second axial position to disengage the stop on the at least one second ramp on the switch cam from the stop on the corresponding at least one first ramp on the support structure, allowing the switch cam to rotate from to its second angular position to its first angular position due to its angular biasing force, resulting in the switch cam axially sliding to its first axial position due to its axial biasing force as the at least one ramp on the first actuator rides down the at least one ramp on the switch cam.

11. A switch mechanism as claimed in claim 7, wherein the second actuator is axially connected to the switch cam so that a sliding movement of the second actuator from its first position to its second position moves the switch cam from its first axial position to its second axial position; wherein, when the first actuator is in its second position and the switch cam is in its second angular position and first axial position, sliding the second actuator from its first position to its second position causes the switch cam to axially slide from its first axial position to its second axial position, which disengages the stop on the at least one second ramp on the switch cam from the stop on the corresponding at least one first ramp on the support structure, allowing the switch cam to rotate from to its second angular position to its first angular position due to the angular biasing force.

12. A switch mechanism as claimed in claim 11, wherein the sliding movement of the second actuator from its first position to its second position also causes the first actuator to return to its first position.

13. A switch mechanism as claimed in claim 12, wherein, when the second actuator returns to its first position from its second position, the switch cam axially slides from its second axial position to its first axial position, the movement of both the second actuator and the switch cam being due to the axial biasing force acting on the switch cam.

14. A switch mechanism as claimed in claim 3, wherein the switch cam comprises a cam surface which engages with an electric switch, the cam surface being arranged so that when the switch cam is in its first position, the electric switch is in a first state and when the switch cam is in its second position, the electric switch is in a second state, the switching mechanism being in its ON state when the electric switch is in its second state.

* * * * *